US005120037A

United States Patent [19]

Takimoto

[11] Patent Number: 5,120,037

[45] Date of Patent: Jun. 9, 1992

[54] AUTOMATIC DOCUMENT FEEDER

[75] Inventor: Kazushi Takimoto, Kadoma, Japan

[73] Assignee: Mita Industrial Co., Ltd., Osaka, Japan

[21] Appl. No.: 439,078

[22] Filed: Nov. 20, 1989

[30] Foreign Application Priority Data

Nov. 29, 1988 [JP] Japan ..... 63-301883

[51] Int. Cl.[5] ..... B65H 83/00

[52] U.S. Cl. ..... 271/3; 271/225; 271/902

[58] Field of Search ..... 271/184, 185, 186, 314, 271/902, 3, 3.1, 7, 225

[56] References Cited

U.S. PATENT DOCUMENTS

| | | | |
|---|---|---|---|
| 3,834,690 | 9/1974 | Knechtel | 271/184 X |
| 4,350,332 | 9/1982 | Knight | 271/188 |
| 4,411,517 | 10/1983 | Gerken | 271/225 X |
| 4,621,799 | 11/1986 | Bastow et al. | 271/10 |
| 4,699,365 | 10/1987 | Smith et al. | 271/3.1 |
| 4,739,983 | 4/1988 | Ide et al. | 271/3 X |
| 4,766,467 | 8/1988 | Yamada et al. | 271/3.1 X |
| 4,921,236 | 5/1990 | Saeki et al. | 271/902 X |

FOREIGN PATENT DOCUMENTS

| | | | |
|---|---|---|---|
| 212983 | 12/1984 | Japan | 271/902 |
| 196425 | 8/1988 | Japan | 271/186 |
| 252832 | 10/1988 | Japan | 271/186 |
| 252833 | 10/1988 | Japan | 271/186 |

*Primary Examiner*—David H. Bollinger
*Attorney, Agent, or Firm*—Jordan and Hamburg

[57] ABSTRACT

An automatic document feeder includes a conveyor belt for transporting a document, a document guide disposed downstream from the conveyor belt and which includes a holding portion in the form of a circular arc, and a discharge roller disposed in such a position as to reverse and discharge the document delivered from the conveyor belt while pressing the document on the holding portion. This automatic document feeder can discharge a document with high reliability by use of a smaller number of parts.

8 Claims, 2 Drawing Sheets

AUTOMATIC DOCUMENT FEEDER

BACKGROUND OF THE INVENTION AND RELATED ART STATEMENT

The present invention relates to an automatic document feeder for use in image forming apparatus such as copying machines, and more particularly to the structure of an automatic document feeder adapted to automatically deliver a document, for example, from a copying position and discharge the document on reversal after the document has been used for copying.

Conventional automatic document feeders of the type mentioned include, for example, the one disclosed in Unexamined Japanese Utility Model Publication SHO 60-159757. This prior-art feeder will be described with reference to the schematic sectional view of FIG. 3. The illustrated automatic document feeder, which is indicated at 31, is placed on the body 32 of a copying machine the top portion only of which is shown. Indicated at 33 is a contact glass plate provided at the top of the machine body 32.

A roller 35 is disposed above a document tray 34. Feed rollers 36 and 37 are arranged downstream from these members. Provided downstream from the feed rollers 37 is a conveyor belt 39 reeved around a drive roller 38*a* and a driven roller 38*b*. The drive roller 38*a* is coupled to an unillustrated drive motor, by which the conveyor belt 39 is driven in the direction of arrow A. Documents on the tray 34 are sent out one by one from the uppermost position by the roller 35 and forwarded to the feed rollers 37 by the feed rollers 36. Each document is then fed onto the glass plate 33 by the feed rollers 37 and the conveyor belt 39.

Disposed downstream from the conveyor belt 39 is an assembly for reversing and discharging the document. More specifically, a transport roller 40 and an idle roller 41 in pressing contact therewith are provided downstream from the belt 39. A discharge roller 42 and an idle roller 43 in pressing contact therewith are arranged at a suitable position above the rollers 40, 41. The idle rollers 41, 43 are biased toward the transport roller 40 and the discharge roller 42 by springs 44, 45, respectively. Guide plates 47, 48 defining a document passage 46 are arranged between the rollers 40, 42. To transport the document efficiently, these guide plates 47, 48 are each in the form of a circular arc. Although not shown, the outer guide plate 47 is formed with ribs to ensure reduced friction. The belts indicated in broken lines are provided for driving the rollers 40, 42 as timed with the conveyor belt 39.

When a copying operation has been completed for the document placed on the glass plate 33, the document is sent as deflected slightly upward to the transport roller 40 by the conveyor belt 39, and transported through the passage 46 by the transport roller 40 and the idle roller 41 to the discharge roller 42, as generally reversed in the direction of its transport. In this way, the document is finally delivered onto an external discharge tray 51 by the discharge roller 42 and the idle roller 43. Thus, the feeder is adapted to reverse and discharge the document with the transport roller for handling the document before reversal, the discharge roller for handling the document after reversal and the smoothly curved document passage.

A device is also known which corresponds to the conventional automatic document feeder of FIG. 3 from which the transport roller 40 and the idle roller 41 are omitted to reduce the number of components and achieve a cost reduction.

The assignee of the present applicant has already proposed an automatic document feeder corresponding to the feeder of FIG. 3 from which the idle roller 43 is also omitted. The proposed feeder is adapted to discharge the document by the operation of a discharge roller 42 made of a relatively soft material such as sponge and ribs at the discharge portion so as to realize a further cost reduction (Japanese Patent Application SHO 63-249114).

With the first-mentioned feeder, the reversal discharge assembly includes a plurality of rollers, especially the transport roller, and therefore requires gears, etc. for the roller coupling mechanism and synchronized rotation of the roller. Further to ensure reliable transport of documents, the transport roller and the discharge roller are provided with idle rollers and springs for pressing the idle rollers into contact with these rollers. Consequently, the assembly is complex in construction, large-sized and costly.

In the case where the transport roller 40 and the idle roller 41 are omitted from the feeder of FIG. 3 or in the case where the idle roller 43 is also omitted along with these rollers, the document must be sent to the discharge roller 42 only with the transport force of the conveyor belt 39. In this case, moreover, the document delivered from the conveyor belt 39 needs to be reversed in the direction of transport and forwarded to the position where it is to be held between the discharge roller 42 and the ribs, so that the feeder is not always capable of transporting the document reliably only with the conveyor belt 39 but permits paper jam. This phenomenon occurs noticeably when the document is thick.

SUMMARY OF THE INVENTION

The main object of the present invention is to overcome the foregoing problems and provide an automatic document feeder having a very simple construction and adapted to reliably reverse and discharge documents.

The automatic document feeder of the present invention comprises a conveyor belt for transporting documents, a document guide disposed downstream from the conveyor belt and comprising an upstream deflecting portion having a deflecting inclination of not greater than 90 degrees and a downstream holding portion in the form of a circular arc, and a discharge roller having a circular cross section concentric with the holding portion, whereby the document delivered from the conveyor belt is reversed and discharged.

With the feeder described above, the document delivered from the conveyor belt is transported to the deflecting portion extending at least in the same direction as the delivery direction, then transported as held between the holding portion and discharge roller along a circular-arc path and thereafter discharged. Accordingly, the document can be reversed and discharged only by the discharge roller. The plurality of rollers conventionally used can therefore be dispensed with. Since the document is held in intimate contact with the discharge roller, there is no need to use idle rollers, springs or like additional members. This simplifies the feeder in construction and renders the feeder compact and less costly to make.

The above and other objects, features and advantages of the present invention will become more apparent from the following detailed description with reference to the accompanying drawings.

DESCRIPTION OF THE PREFERRED EMBODIMENT

An embodiment of the invention will be described in detail with reference to the drawings concerned.

Figure 1:
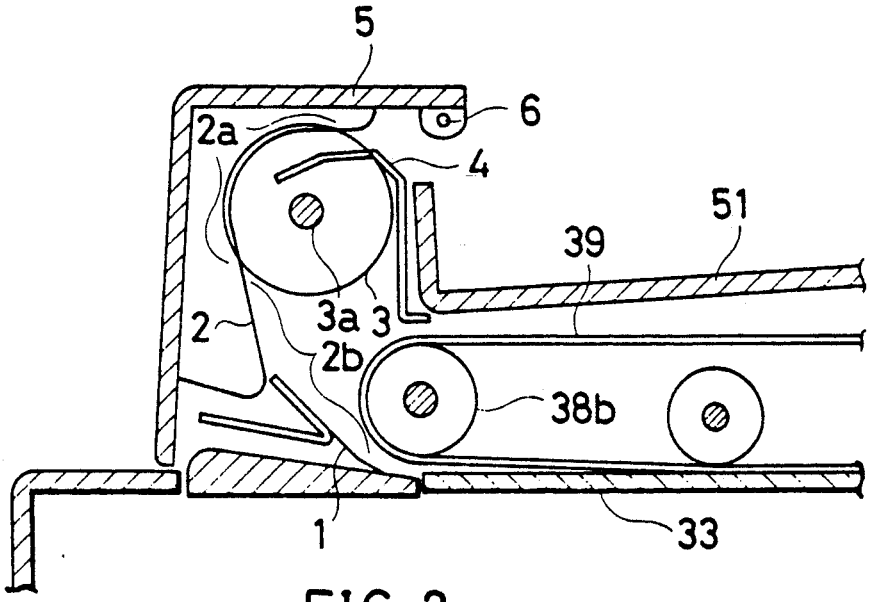
FIG. 1 is a sectional view schematically showing a reversal discharge assembly included in an automatic document feeder embodying the invention.

FIG. 1 shows the embodiment of the invention and is a schematic view in section of a reversal discharge assembly included in an automatic document feeder. Throughout the accompanying drawings, like parts are designated by like reference numerals.

With reference to FIG. 1, a deflecting member 1 is disposed downstream from the driven roller 38*b* of a conveyor belt 39 immediately adjacent thereto. The document delivered from the belt 39 is directed toward the discharge roller to be described below by the deflecting member 1. The deflecting member 1 is relatively gently curved so that the document can be smoothly delivered onto the member 1 by the document transport force of the conveyor belt 39.

A guide member 2 having a plurality of ribs for further guiding the document is disposed at the downstream end of the deflecting member 1. The guide member 2 has a substantially straight upstream portion and a circular-arc downstream portion 2*a* (hereinafter referred to as a "holding portion").

Figure 2:
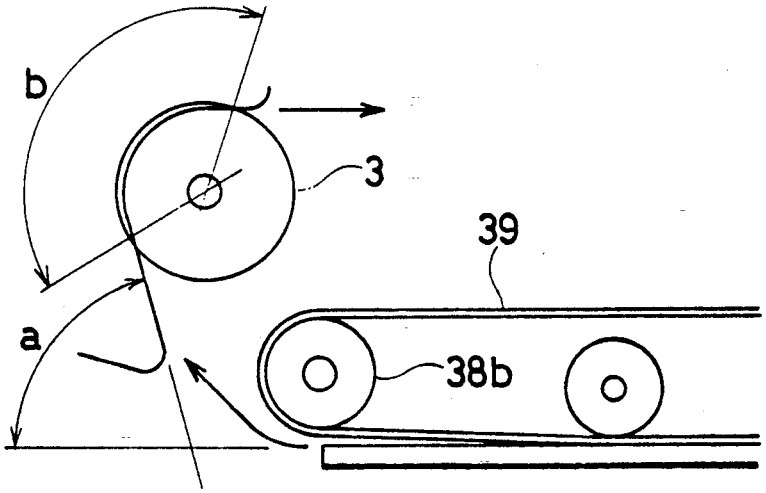
FIG. 2 is a diagram for illustrating the inclination of a deflecting portion and the angle of a holding portion.
Figure 3:
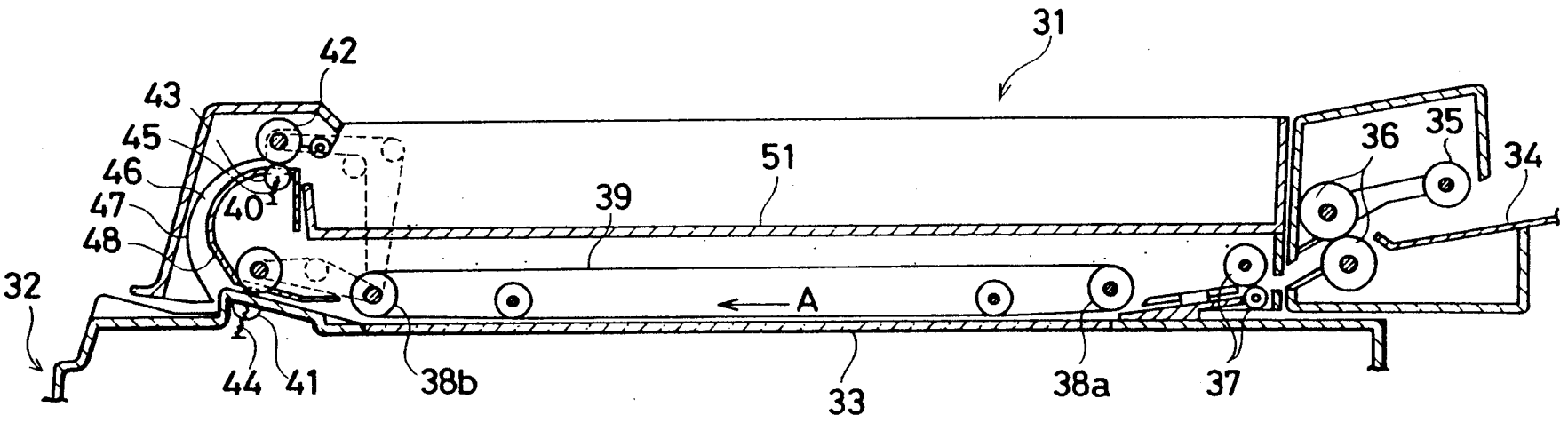
PRIOR ART FIG. 3
FIG. 3 is a schematic view in section of a conventional automatic document feeder.

As shown in FIG. 2, the portion 2*b* (hereinafter referred to as a "deflecting portion") comprising the straight upstream portion of the guide member 2 and the deflecting member 1 has a maximum inclination a of up to 90 degrees with respect to the direction of transport by the conveyor belt 39 so that the document delivered from the belt 39 will not be reversed at least at this portion 2*b*. Since the inclination a is not greater than 90 degrees, the document delivered from the belt 39 can be smoothly transported to the holding portion 2*a*.

A discharge roller 3 having a circular cross section concentric with the holding portion 2*a* is positioned as opposed to the holding portion 2*a*. The discharge roller 3 comprises a rotary shaft 3*a* at its center, and a material having the desired coefficient of friction, such as sponge, and has a radius at least equal to or slightly greater than the radius of the circular arc of the holding portion 2*a*. Further as seen in FIG. 2, the discharge roller 3 is in contact with the holding portion 2*a* over an angle b which is relatively large. When the inclination a is assumed to be 90 degrees (maximum), the angle b is 90 degrees so that the document transported from immediately below the portion 2*a* can be further transported toward a reversing direction for discharge. Accordingly, the angle b must be at least 90 degrees.

The document delivered to the deflecting portion 2*b* and transported to the upstream end of the holding portion 2*a* is held between the holding portion 2*a* and the discharge roller 3, revolvingly transported with the discharge roller 3 by frictional contact with the roller 3 and discharged onto a discharge tray 51.

A guide member 4 is disposed on the discharge side of the roller 3 for preventing the document from being wound on the roller without discharging. The discharge assembly is provided with a cover 5 pivotally movable about a pin 6. Paper jams or like troubles occurring in the vicinity of the deflecting member 1 or the discharge roller 3 can be remedied by pivotally moving the cover 5 and the guide member 2 attached to the cover 5 upward about the pin 6 to an opened position.

Although the present embodiment includes the deflecting member 1 and the guide member 2 which provide a document guide, these members may be made integral in the form of a single member.

The greater the angle b, the more reliably can the document be transported revolvingly. The angle can be set to a desired value in view of other factors, such as the coefficient of friction and radius of the discharge roller 3, the material of the guide member, etc.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. An automatic document feeder for feeding a document comprising:

a feeder structure;

a conveyor means on said feeder structure for transporting said document along a horizontal conveying path;

a discharge tray overlying said conveyor means;

a discharge roller rotatably mounted on said feeder structure and disposed in an inner side of a reverse conveying path in which the direction of said document is reversed and discharged into said overlying discharge tray, the reverse conveying path being downstream of said horizontal conveying path, said discharge roller having an axis of rotation;

restrictive means disposed on an outer side of said reverse conveying path for restricting the moving direction of said document, the restrictive means consisting of a holding portion and a deflecting portion, said holding portion consisting of a guide surface, the guide surface being inner surfaces of a plurality of guide ribs arranged in parallel with said rotation axis of said discharge roller, the inner surfaces having the form of a circular arc of at least 90° and facing said discharge roller and having a cylindrical axis which is substantially coincident with the rotation axis of said discharge roller, said deflecting portion consisting of a deflecting surface upstream of said guide surface and operable to deflect said document to said guide surface, said deflecting surface having a maximum inclination of up to 90° relative to said horizontal conveying path, said guide surface being continuous with said deflecting surface;

whereby said document is transported from said horizontal conveying path by said conveyor means, guided to said guide surface by said deflecting portion, and pressed against said guide surface such that said discharge roller is operable to charge said document into said discharge tray.

2. An automatic document feeder according to claim 1, wherein said feeder structure is provided with a cover pivotable about an axis parallel with said rotation axis of said discharge roller, said plurality of guide ribs being mounted on said cover.

3. An automatic document feeder according to claim 2, wherein said cover overlies and also extends to one side of said roller, said cover having an inside juxtaposed to said roller, said holding portion and said deflecting portion being integral with said inside of said cover.

4. An automatic document feeder according to claim 2, wherein said cover has a generally L-shaped configuration having one leg portion overlying said roller and another leg portion extending generally perpendicular from said one leg portion, said one leg portion being pivotably mounted on said feeder structure.

5. An automatic document feeder according to claim 1, wherein said deflecting portion is defined by deflecting inner surfaces of the same number of deflection ribs as said plurality of guide ribs, said deflecting inner surfaces being continuous with said guide surface and extending tangentially from said guide surface.

6. An automatic document feeder according to claim 1, wherein said discharge tray has one end juxtaposed to said roller such that said roller is operable to discharge said document directly into said discharge tray.

7. An automatic document feeder according to claim 1, wherein said roller has a diameter equal to the diameter of said inner surface of said guide ribs.

8. An automatic document feeder for feeding a document comprising:

a feeder structure;

a conveyor means on said feeder structure for transporting said document in a first direction;

a discharge tray overlying said conveyor means;

a discharge roller rotatably mounted on said feeder structure and disposed in an inner side of a reverse conveying path in which the direction of said document is reversed and discharged into said overlying discharge tray, the reverse conveying path being downstream of said horizontal conveying path, said discharge roller having an axis of rotation;

restrictive means disposed on an outer side of said reverse conveying path for restricting the moving direction of said document, the restrictive means consisting of a holding portion and a deflecting portion, said holding portion consisting of a guide surface, the guide surface being inner surfaces of a plurality of guide ribs arranged in parallel with said rotation axis of said discharge roller, the inner surfaces having the form of a circular arc of at least 90° and facing said discharge roller and having a cylindrical axis which is substantially coincident with the rotation axis of said discharge roller, said deflecting portion consisting of a deflecting surface upstream of said guide surface and operable to deflect said document to said guide surface, said deflecting surface having a maximum inclination of up to 90° relative to said horizontal conveying path, said guide surface being continuous with said deflecting surface;

a cover pivotably mounted on a shaft provided on said feeder structure in parallel with said rotation axis of said discharge roller, said cover carrying said holding portion and said deflecting portion;

whereby said document is transported from said horizontal conveying path by said conveyor means, guided to said guide surface by said deflecting portion, and pressed against said guide surface such that said discharge roller is operable to discharge said document into said discharge tray, said cover being pivotable between an operable position in which said cover overlies said roller to protect said roller and define said reverse conveying path between said discharge roller and said restrictive means, and an open position in which said roller is exposed to provide access to said roller.

* * * * *